US010736351B2

(12) United States Patent
Kaihatsu et al.

(10) Patent No.: US 10,736,351 B2
(45) Date of Patent: Aug. 11, 2020

(54) SMOKING ARTICLE WITH FILTER AND FILTER OF SMOKING ARTICLE

(71) Applicant: JAPAN TOBACCO INC., Tokyo (JP)

(72) Inventors: Yutaka Kaihatsu, Tokyo (JP); Shota Hashimoto, Tokyo (JP); Michihiro Inagaki, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 217 days.

(21) Appl. No.: 15/810,961

(22) Filed: Nov. 13, 2017

(65) Prior Publication Data

US 2018/0064161 A1 Mar. 8, 2018

Related U.S. Application Data

(63) Continuation of application No. PCT/JP2016/063214, filed on Apr. 27, 2016.

(30) Foreign Application Priority Data

May 13, 2015 (JP) ..... 2015-098080

(51) Int. Cl.
*A24D 3/04* (2006.01)
*A24D 3/08* (2006.01)
(Continued)

(52) U.S. Cl.
CPC ..... *A24D 3/04* (2013.01); *A24D 3/043* (2013.01); *A24D 3/048* (2013.01); *A24D 3/061* (2013.01);
(Continued)

(58) Field of Classification Search
CPC ..... A24D 3/04; A24D 3/043; A24D 3/048; A24D 3/061; A24D 3/08; A24D 3/10; A24D 3/14
See application file for complete search history.

(56) References Cited

U.S. PATENT DOCUMENTS 4,655,229 A 4/1987 Sensabaugh, Jr. et al.
4,889,144 A 12/1989 Tateno et al.
(Continued)

FOREIGN PATENT DOCUMENTS

CN 101193564 A 6/2008
CN 102711532 A 10/2012
(Continued)

OTHER PUBLICATIONS

Japanese Office Action, dated Jul. 31, 2018, for Japanese Application No. 2017-517879, along with an English translation.
(Continued)

*Primary Examiner* — Joseph S Del Sole
*Assistant Examiner* — Jamel M Nelson
(74) *Attorney, Agent, or Firm* — Birch, Stewart, Kolasch & Birch, LLP

(57) ABSTRACT

Provided is a smoking article that allows easy inhaling of a powder at a smoker's own timing, and can suppress powder spill at an unintentional timing such as during production or shipment. The smoking article includes: a tobacco rod containing tobacco; and a filter connected to an end part of the tobacco rod through a tipping paper. The filter includes a powder-containing substance that is a lump of a crude powder containing at least one of a gustatory component and a flavor component, and turns into powder when external force is applied thereon, a cavity in which the powder-containing substance is placed, and a flow path that connects the cavity and a mouthpiece end, allows passage of the powder, and has a smaller inner diameter than an outer diameter of the powder-containing substance.

9 Claims, 12 Drawing Sheets

(51) Int. Cl.

| | |
|---|---|
| ***A24D 3/14*** | (2006.01) |
| ***A24D 3/06*** | (2006.01) |
| ***A24D 3/10*** | (2006.01) |

(52) U.S. Cl.

CPC ..... *A24D 3/08* (2013.01); *A24D 3/10* (2013.01); *A24D 3/14* (2013.01)

(56) References Cited

U.S. PATENT DOCUMENTS

| | | | | |
|---|---|---|---|---|
| 2004/0261807 | A1* | 12/2004 | Dube | A24D 3/061 131/337 |
| 2007/0012327 | A1 | 1/2007 | Karles et al. | |
| 2007/0235050 | A1* | 10/2007 | Li | A24D 3/045 131/338 |
| 2008/0230079 | A1 | 9/2008 | Besso et al. | |
| 2011/0100387 | A1 | 5/2011 | Karles et al. | |
| 2012/0260928 | A1* | 10/2012 | Herholdt | A24D 3/048 131/335 |
| 2014/0026900 | A1 | 1/2014 | Karles et al. | |
| 2014/0166031 | A1 | 6/2014 | Bailey et al. | |

FOREIGN PATENT DOCUMENTS

| | | | |
|---|---|---|---|
| GB | 2490730 | A | 11/2012 |
| JP | 60-192581 | A | 10/1986 |
| JP | 64-27461 | A | 1/1989 |
| JP | 2709077 | B2 | 2/1998 |
| JP | 2008-539717 | A | 11/2008 |
| JP | 2013-515475 | A | 5/2013 |
| JP | 2014-513539 | A | 6/2014 |
| KR | 10-2010-0014354 | A | 2/2010 |
| TW | 201143644 | A1 | 12/2011 |
| WO | WO 2014/128973 | A1 | 8/2014 |
| WO | WO 2014/155378 | A1 | 10/2014 |
| WO | WO 2015/190256 | A1 | 12/2015 |

OTHER PUBLICATIONS

International Searching Authority (Forms PCT/IB/338, PCT/IB/373 and PCT/ISA/237), dated Nov. 23, 2017, for International Application No. PCT/JP2016/063214.

International Search Report, issued in PCT/JP2016/063214, dated Aug. 2, 2016.

Taiwanese Office Action, issued in the corresponding application No. 105113255, dated Mar. 14, 2017.

Russian Office Action and Search Report, dated Apr. 19, 2018, for Russian Application No. 2017143376, as well as an English translation.

Extended European Search Report dated Oct. 16, 2018, for corresponding European Patent Application No. 16792568.4.

Chinese Office Action and Search Report, dated Sep. 17, 2019; for Chinese Application No. 201680032796.6, along with an English translation.

Korean Office Action for Korean Application No. 10-2017-7032597, dated Feb. 7, 2020, with English translation.

Japanese Office Action for Japanese Application No. 2018-163791, dated Apr. 7, 2020, with English translation.

* cited by examiner

FIG. 9

| | Aperture on AF | | Aperture on cavity | | | | | | |
|---|---|---|---|---|---|---|---|---|---|
| Average of Vf value | 80.86 | 25.28 | 81.62 | 61.72 | 31.24 | 26.56 | 17.12 | 11.98 | 7.48 |
| Each sample of Vf value | 81.6 | 17.2 | 83.5 | 60.4 | 29.8 | 26.8 | 15.7 | 8.7 | 7 |
| | 81 | 29.2 | 82.4 | 68 | 34.4 | 24.7 | 15.9 | 10 | 5.9 |
| | 82.8 | 18.9 | 79.8 | 61.8 | 27.8 | 27.6 | 22.8 | 16.2 | 7.6 |
| | 78.9 | 33.9 | 82.7 | 58.3 | 29.8 | 30.3 | 11 | 11.1 | 7.2 |
| | 80 | 27.2 | 79.7 | 60.1 | 34.4 | 23.4 | 20.2 | 13.9 | 9.7 |

SMOKING ARTICLE WITH FILTER AND FILTER OF SMOKING ARTICLE

CROSS-REFERENCE TO RELATED APPLICATIONS

The present application is a continuation application of International Application PCT/JP2016/063214 filed on Apr. 27, 2016, which claims priority to Japanese Patent Application No. 2015-098080, filed on May 13, 2015. The contents of these applications are incorporated herein by reference in their entirety.

TECHNICAL FIELD

The present invention relates to a smoking article with a filter and a filter of a smoking article.

BACKGROUND ART

In known cigarettes, a powder inside a filter is inhaled to enjoy taste and/or aroma. For example, Patent document 1 discloses that particulate matter is contained in a chamber inside a filter, and the particulate matter is delivered to an output end through a flow path. Patent document 2 discloses, as a technique related to cigarette products, that a flavor is encapsulated in a solid particulate famed of natural polysaccharides or their derivatives. Patent document 3 discloses a filter cigarette that has a capsule including a powder.

[Patent document 1] Japanese Patent Laid-Open No. 60-192581

[Patent document 2] Japanese Patent Laid-Open No. 64-27461

[Patent document 3] International Publication No. WO 2014/155378

SUMMARY OF INVENTION

Technical Problem

In the known cigarettes, a powder inside a filter is inhaled to enjoy taste and/or aroma. In this conventional technique, although the taste and/or aroma of the powder can be enjoyed, the powder may spill (hereinafter, spilling of a powder is also referred to as powder spill) at an unintended timing such as during production and shipment. The cigarette described in Patent document 1 which is an example of such cigarettes has flow paths and gaps with different diameters famed inside the filter. However, in the cigarette, the configuration of the filter only becomes complex, and the flow path of the powder is not blocked. Hence, powder spill may occur.

As an example of a cigarette with a filter, Patent document 3 discloses a filter cigarette that has a capsule including a powder. In this conventional cigarette, two or more holes are formed in the capsule, and the powder included in the capsule is inhaled through holes. Hence, flow paths of the powder are not completely blocked. By providing less holes and reducing the diameter of the holes, the effect of suppressing powder spill can be improved. However, less holes and a smaller diameter of the hole are likely to hinder inhaling of the powder. Note that the above problems are not limited to a cigarette, and the same applies to general smoking articles including a cigar, a cigarillo, smoking tools such as a heated electronic device or a carbon heat source, and a non-heated cigarette tool.

In view of the foregoing, an objective of the present invention is to provide a technique related to a smoking article that allows easy inhaling of a powder having taste and/or aroma at a smoker's own timing, and can suppress powder spill at an unintentional timing such as during production or shipment.

Solution to Problem

To solve the above problems, the present invention provides a powder-containing substance which turns into powder when external force is applied thereon, and is a lump of a crude powder containing at least one of a gustatory component and a flavor component. The inner diameter of a flow path that allows passage of the powder is smaller than the outer diameter of the powder-containing substance.

More specifically, a smoking article of the present invention includes: a tobacco rod containing tobacco; and a filter connected to an end part of the tobacco rod through a tipping paper. The filter includes a powder-containing substance that is a lump of a crude powder containing at least one of a gustatory component and a flavor component, and turns into powder when external force is applied thereon, a cavity in which the powder-containing substance is placed, and a flow path that connects the cavity and a mouthpiece end, allows passage of the powder, and has a smaller inner diameter than an outer diameter of the powder-containing substance.

According to the smoking article of the present invention, the smoker can inhale a powder by applying an external force and turning the powder-containing substance into powder. The powder can easily pass through the flow path. Hence, the smoker can easily inhale the powder at his/her own timing. The flow path has a smaller inner diameter than the outer diameter of the powder-containing substance. Hence, the powder-containing substance does not pass through the flow path. In other words, spilling of powder (powder spill) at unintended timings such as during production and shipment can be suppressed.

The flow path having a smaller inner diameter than the outer diameter of the powder-containing substance means, in other words, that the flow path is configured to block passage of the powder-containing substance. Hence, this means if there are multiple flow paths, for example, all of the flow paths have a smaller inner diameter than the outer diameter of the powder-containing substance, in other words, all of the flow paths are configured to block passage of the powder-containing substance. Note that the inner diameter of the flow path does not necessarily have to be constant, and may vary. If the inner diameter of the flow path varies, it may be set in any way, as long as the minimum inner diameter is set smaller than the outer diameter of the powder-containing substance. The position of the minimum inner diameter is not particularly limited. The position of the minimum inner diameter may be an intermediate point in the flow path, or at an end part of the flow path. End parts of the flow path include an upstream end part (end part on cavity side) and a downstream end part (end part on mouthpiece side).

Examples of a smoking article include a cigarette, a cigar, a cigarillo, smoking tools for inhaling taste and/or aroma of a cigarette by a heated electronic device or a carbon heat source, for example, and smoking tools for inhaling taste and/or aroma of a cigarette by a non-heated cigarette tool.

The powder-containing substance may include at least one of a powder compact, a tableted body, and a powder-containing capsule. A powder compact can be obtained by adding water to monosaccharides, disaccharides, polysaccharides or their derivatives which are a nucleating agent (crude powder) of the powder compact, mixing them together, compacting the material, and then drying. Note that a raw material may be added as a binder. A flavor may be added with the water. The shape and number of powder-containing substance is not particularly limited. The powder-containing substance may be a spherical shape, an ellipsoid, a column, a hollow cylinder, a conical, a pyramid, a torus, a polyhedron such as a cube and a rectangular parallelepiped, or a combination of these shapes.

The outer diameter of the powder-containing substance should preferably be designed such that a gap is famed with a wall that forms the outline of the cavity. This can suppress unintended powderization of the powder-containing substance due to contact between the wall forming the outline of the cavity and the powder-containing substance during production, for example. Accordingly, when the inner diameter of the cavity of the smoking article exceeds 8 mm, for example, the outer diameter of the powder-containing substance may be not smaller than 1 mm and not larger than 8 mm. Preferably, the outer diameter of the powder-containing substance should be not smaller than 2 mm and not larger than 6 mm. Cavity refers to a space formed by placing a filter by separating it from a filter or a tobacco rod, or a space famed inside the filter. The wall that forms the outline of the cavity separates the cavity and the other areas inside the filter. The cavity only needs to be three-dimensional such as columnar and spherical. Multiple cavities may be formed. For example, when the cavity is famed into a columnar shape along the longitudinal direction of the filter, the wall forming the outline of the cavity includes a wall that separates the upstream side or downstream side of the cavity, and a wall that separates the circumferential face of the cavity. "Upstream" and "downstream" indicate positional relationships relative to the flow of mainstream smoke. Examples of the wall separating the upstream side of the cavity include a downstream end face (rear end face of tobacco rod) of the tobacco rod, and a downstream end face (rear end face of upstream filter) of the upstream filter adjacent to the upstream side of the cavity. Examples of the wall formed on the downstream side of the cavity include a downstream end face (front end face of the downstream filter) of the downstream filter adjacent to the downstream side of the cavity. The wall separating the circumferential face of the cavity may be a part of a paper covering the filter such as a tipping paper and a wrapping paper, or may be a filter part such as an outer circumferential wall of the so-called center hole filter.

An external force is a force stronger than a force applied during production or shipment, or is a force stronger than inhaling force while smoking. An example of external force is a force (crushing force) applied by fingers of the smoker. For example, the fracture strength that turns the powder-containing substance into powder is not lower than 5 N and not higher than 60 N. The fracture strength that turns the powder-containing substance into powder is preferably not lower than 20 N and not higher than 30 N, and more preferably, is not lower than 20 N and not higher than 25 N.

In the powder-containing substance, the crude powder having a particle size not smaller than 10 μm and not larger than 600 μm may be not lower than 50 wt % of the entire weight of the powder-containing substance. Preferably, in the powder-containing substance, the crude powder having a particle size not smaller than 50 μm and not larger than 300 μm may be not lower than 30 wt % of the entire weight of the powder-containing substance. Thus, the powder-containing substance easily turns into a powder having a particle size adequate for inhaling, when external force is applied thereon.

The tipping paper may have an air hole for taking in dilution air into the filter, in a position corresponding to the cavity. This can achieve a drastic change in the taste intensity or the like by the powder obtained by applying external force on the powder-containing substance, without significantly varying the tar value of the cigarette. Note that the air hole for taking in dilution air may be provided in a position corresponding to the upstream filter, or may be provided in a position corresponding to the downstream filter.

The filter may have an upstream filter positioned on the upstream side of the cavity, and a downstream filter positioned on the downstream side of the cavity and include a flow path that allows passage of the powder. The air hole in the tipping paper may be provided not only in the position corresponding to the cavity, but also in a position corresponding to the upstream filter. With this configuration designed such that the total diluted amount of air becomes substantially equivalent, it is possible to design an optimal taste intensity, etc. by the powder obtained by applying external force on the powder-containing substance, while maintaining a constant tar value of the smoking article.

A flavor capsule including a flavor may also be provided in the filter. With this configuration, by containing a taste component (also referred to as "gustatory component") in the powder-containing substance and containing an aroma component in the flavor capsule, for example, the user can selectively crush one of them to selectively customize the intensity of the taste component and the aroma component. Instead, the user may crush both of the powder-containing substance and the flavor capsule, to customize the intensity of both of the taste component and the aroma component.

The filter may also have an upstream filter positioned on the upstream side of the cavity; and the flavor capsule may be placed in the upstream filter. With this configuration, ease in production when producing the filter can be improved. By placing the flavor capsule in a part separate from the powder-containing substance, the user is allowed to easily select and crush the desired one of the flavor capsule and the powder-containing substance. When placing the flavor capsule in the upstream filter as mentioned above, it is more preferable that the air hole be provided in the upstream filter, and the flavor capsule be place on the downstream side (mouthpiece side) of the air hole. The flow rate is higher on the downstream side area of the air hole than on the upstream side area. Hence, by placing the flavor capsule in such a position, a larger amount of aroma components can be released. Accordingly, the aroma component easily mixes with mainstream smoke when the flavor capsule is crushed. That is, it is possible to customize the flavor to release when crushing the flavor capsule.

The present invention may be specified as a filter of the aforementioned smoking article. Specifically, the present invention is a filter of a smoking article including: a powder-containing substance that is a lump of a crude powder containing at least one of a gustatory component and a flavor component, and turns into powder when external force is applied thereon; a cavity in which the powder-containing substance is placed; and a flow path that connects the cavity and a mouthpiece end, allows passage of the powder, and has a smaller inner diameter than an outer diameter of the powder-containing substance.

Note that the means for solving the problems of the present invention may be combined in any possible way.

ADVANTAGEOUS EFFECTS OF INVENTION

The present invention provides a technique related to a smoking article that allows easy inhaling of a crude powder containing a gustatory component at a smoker's own timing, and can suppress powder spill at an unintentional timing such as during production or shipment.

BRIEF DESCRIPTION OF THE DRAWINGS

FIG. 9 illustrates a table of Vf value measurement results of an example of Embodiment 2.

DESCRIPTION OF EMBODIMENTS

Hereinafter, embodiments of a cigarette with a filter of the present invention will be described in detail with reference to the drawings. The dimension, material, shape, and relative arrangements, for example, of components described in the embodiments are not intended to limit the technical scope of the invention, unless particularly stated.

Embodiment 1

(Configuration)

Figure 1:
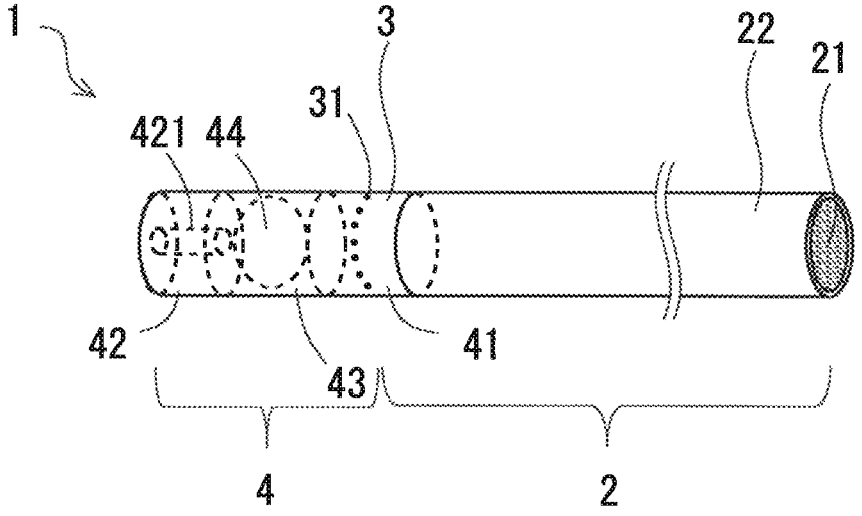
FIG. 1 illustrates an external perspective view of a cigarette of Embodiment 1.
Figure 2:
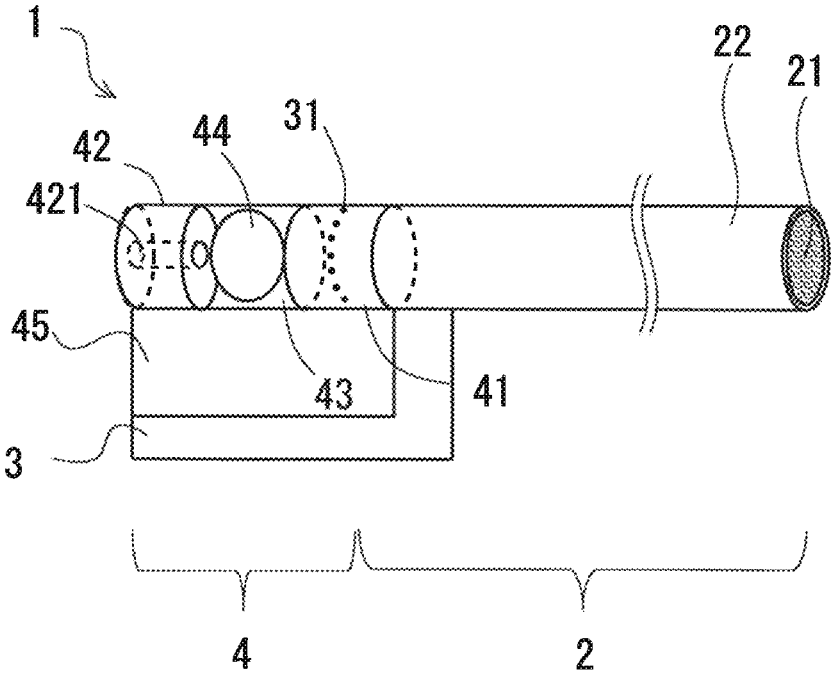
FIG. 2 illustrates an exploded perspective view of the cigarette of Embodiment 1.
Figure 3:
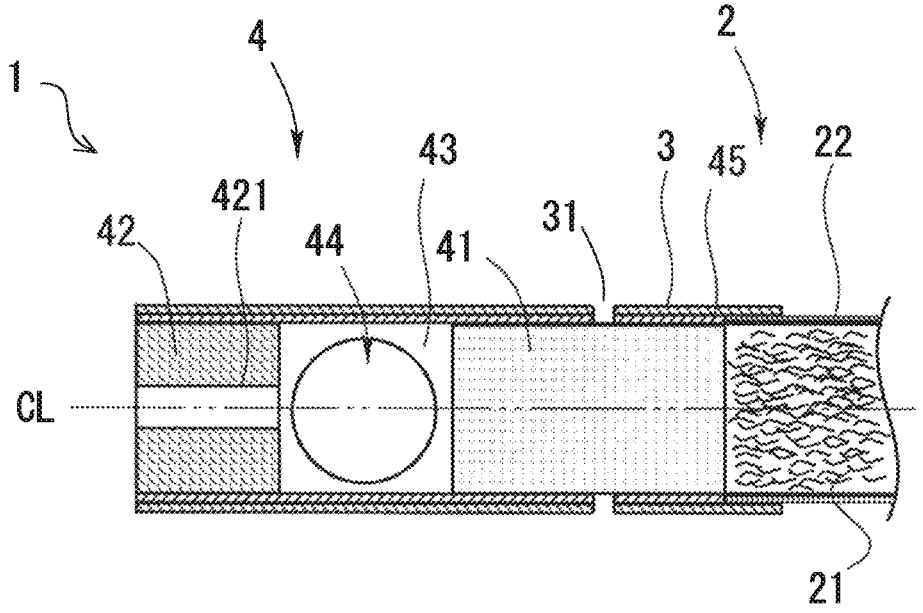
FIG. 3 illustrates a longitudinal section of the cigarette of Embodiment 1.

As illustrated in FIGS. 1 to 3, a cigarette 1 is a cigarette with a filter, including a tobacco rod 2 and a filter 4 connected to one end of the tobacco rod 2 through a tipping paper 3.

The tobacco rod 2 is tobacco 21 wrapped into a columnar shape (rod shape) with a cigarette paper 22, and is also referred to as "single roll." The filter 4 is a member for filtering a smoke component contained in mainstream smoke, when the filter 4 allows passage of the mainstream smoke generated from smoking of the cigarette 1. The filter 4 is famed into a columnar shape having substantially the same diameter as the tobacco rod 2.

The filter 4 is wrapped in a wrapping paper 45 and the tipping paper 3, and is connected to the rear end side of the tobacco rod 2 through the tipping paper 3. The tipping paper 3 wraps an end part of the tobacco rod 2 integrally with the filter 4, and thereby connects (joins) the parts together. Hereinafter, in the longitudinal direction (axial direction) of the tobacco rod 2, an end part that is connected to the filter 4 is referred to as "rear end," and an end part opposite thereto is referred to as "front end" (tip end). In the longitudinal direction (axial direction) of the filter 4, an end part connected to the tobacco rod 2 is referred to as "front end," and an end part opposite to the front end is referred to as "mouthpiece end." A section of the cigarette 1 (tobacco rod 2, filter 4) along the longitudinal direction (axial direction) is defined as "longitudinal section," and a section in a direction perpendicular thereto is defined as "cross section." "Upstream" and "downstream" indicate positional relationships relative to the flow of mainstream smoke. Note that reference symbol CL illustrated in FIG. 3 indicates the center axis of the cigarette 1 (tobacco rod 2, filter 4).

The configuration of the filter 4 includes an upstream filter 41 connected to the rear end side of the tobacco rod 2, a downstream filter 42 positioned on the mouthpiece end side, a cavity 43 formed between the upstream filter 41 and the downstream filter 42, and a powder-containing substance 44 accommodated in the cavity 43. The powder-containing substance 44 is an example of a powder-containing substance which is a lump of a crude powder. The powder-containing substance 44 turns into powder when it is fractured. Details will be described later. The wrapping paper 45 wraps the upstream filter 41, the downstream filter 42, and the cavity 43. Moreover, the tipping paper 3 outside the wrapping paper 45 wraps the entire filter 4 and a part of the tobacco rod 2.

Other than a generally known acetate filter or a charcoal filter, the upstream filter 41 may be a filter containing particulate matter other than charcoal such as cellulose, a fiber-containing filter, or a center core filter in which the same or multiple different filters are coaxially arranged. The upstream filter 41 may be configured of two or more segments. The length of the upstream filter is 5 to 20 mm, for example. The diameter of the upstream filter 41 is 5 to 10 mm, for example.

Examples of a filler of the upstream filter 41 include vegetable fibers such as cotton, hemp, Manila hemp, palm, and rush, animal fibers such as wool and cashmere, regenerated cellulose fibers such as rayon, semi-synthetic cellulose fibers such as acetate, diacetate, and triacetate, synthetic fibers such as nylon, polyester, acryl, polyethylene, and polypropylene, and a combination of these.

Examples of plasticizers which can be used in the upstream filter 41 include, for example, triethyl citrate, acetyl triethyl citrate, acetyl tributyl citrate, dibutyl tartrate, ethyl phthalyl ethyl glycolate, methyl phthalyl ethyl glycolate, triacetin, triethyl phosphate, triphenyl phosphate, tripropionin, and a combination of these. Instead, the upstream filter 41 may omit the plasticizer.

As in the case of the upstream filter 41, the downstream filter 42 may be configured of an acetate filter or a charcoal filter.

A columnar flow path 421 that communicates into the cavity 43 and the mouthpiece end is formed in a center part of the downstream filter 42. The length of the downstream filter is 5 to 15 mm, for example. The diameter of the downstream filter 42 is 5 to 10 mm, for example. Note that the downstream filter 42 may be configured of two or more segments. Multiple flow paths 421 may be formed. The flow path 421 may be formed into a curved or helical shape. Moreover, the flow path 421 may include bifurcation or confluence at in intermediate point thereof. The diameter of the flow path 421 may vary in an intermediate point. The downstream filter 42 may also include a non-penetrating flow path (not shown), in addition to the penetrating flow path 421. By providing the non-penetrating flow path, the flow rate of the penetrating flow path 421 can be suppressed. As a result, the feed rate of powder can be suppressed. The length of the flow path 421 may be set to 5 to 15 mm. The inner diameter of the flow path 421 is not particularly limited, as long as it is smaller than the outer diameter of the powder-containing substance 44. Note that a plasticizer is preferably used in the downstream filter 42, to suppress defamation of the flow path 421 when external force is applied on the filter 4.

Instead of the circular shape, the cross section of the flow path 421 may be formed into an oval, a triangle, a rectangle, a diamond shape, a parallelogram, a trapezoid, a polygon such as a cross shape, or a combination of these. Note that the mouthpiece end may be formed into a recessed shape recessed toward the front end side. The recessed shape can improve the design of the flow path 421.

The wrapping paper 45 used for the filter 4 may be an air-permeable wrapping paper used for a general product, or may be air impermeable. Although a paper made from a vegetable fiber is normally used as the material of the wrapping paper 45, a sheet formed of a synthetic polymer-based (e.g., polypropylene, polyethylene, and nylon) fiber or a polymer-based sheet may be used, or a metal foil such as an aluminum foil may be used.

Note that a so-called non-wrapped filter may be used as the filter 4. A non-wrapped filter has a filter material and an outer layer that forms the filter material into a columnar shape. The outer layer can be obtained by thermoforming the filter material. When using the non-wrapped filter, the wrapping paper may be omitted.

Although a paper made from a vegetable fiber is normally used as the tipping paper 3, a sheet formed of a synthetic polymer-based (e.g., polypropylene, polyethylene, and nylon) fiber or a polymer-based sheet may be used, or a metal foil such as an aluminum foil may be used. Note that the filter 4 may contain a flavor such as menthol. While the method of adding the flavor is not particularly limited, examples of known methods include placing a fiber-like substance containing a flavor in the filter 4, including a flavor in a filler of the filter 4, and placing a flavor-fixed material such as a capsule in the filter 4.

Multiple air holes 31 that introduce ventilation air (outside air) into the filter 4 and dilute mainstream smoke are famed annularly, on a part of the wrapping paper 45 and the tipping paper 3 closer to the front end than the cavity 43. The air holes 31 may be opened by a mechanical method of press-opening by a needle punch, an electric method by corona discharge, or a method of dividing, into pulses, a continuous output beam output from a laser oscillator while continuously running the filter tip, by use of a rotating chopper, irradiating the divided beam, and opening the holes, for example.

The cavity 43 is a space formed inside the filter 4, and specifically, is formed of a columnar space surrounded by a rear end face of the upstream filter 41, a front end face of the downstream filter 42, and the wrapping paper 45. The cavity 43 may be any size, as long as it is large enough to install the powder-containing substance 44. When installing multiple powder-containing substances 44, the cavity 43 needs to be large enough to install the multiple powder-containing substances 44. The length of the cavity 43 is 5 to 20 mm, for example. The inner diameter of the cavity 43 is 5 to 10 mm, for example. Note that the cavity 43 may be omitted, and the powder-containing substance 44 may be installed in the filter. In this case, to avoid mixing of the tobacco 21 and the powder-containing substance, it is preferable that a filter not having a through-hole be installed closer to the front end than the powder-containing substance 44. The shape of the cavity 43 is not particularly limited. The cavity 43 may be famed into other three-dimensional shapes such as a spherical shape. Multiple cavities 43 may be formed.

The powder-containing substance 44 is a spherical lump of the crude powder, and turns into powder when external force is applied thereon. An external force is a force stronger than a force applied during production or shipment, or is a force stronger than inhaling force while smoking. An example of external force is a force (crushing force) applied by fingers of the smoker. For example, the fracture strength that turns the powder-containing substance 44 into powder is not lower than 5 N and not higher than 60 N. The fracture strength that turns the powder-containing substance 44 into powder is preferably not lower than 20 N and not higher than 30 N, and more preferably, is not lower than 20 N and not higher than 25 N. The shape of the powder-containing substance 44 is not limited. The powder-containing substance 44 may be an ellipsoid, a column, a hollow cylinder, a conical, a pyramid, a torus, a polyhedron such as a cube and a rectangular parallelepiped, or a combination of these shapes. Multiple powder-containing substances 44 may be provided.

At least a part of the powder has a particle size that can pass through the flow path 421. In other words, the particle size of the crude powder is preferably not smaller than 10 μm and not larger than 300 μm, and is a particle size within a range of 50 to 300 μm, for example.

The powder-containing substance 44 can be produced by adding an adequate amount of water to a nucleating agent as a crude powder, mixing them together, compacting the material, and then drying. A binder may be added as a raw material. A flavor may be added with the water. Monosaccharides, disaccharides, polysaccharides or their derivatives may be used as a nucleating agent. Examples of the material include: ketotriose (dihydroxyacetone), aldotriose (glyceraldehyde), ketotetrose (erythrulose), aldotetrose (erythrose, threose), pentose ketopentose (ribulose, xylulose), aldopentose (ribose, arabinose, xylose, lyxose), deoxy sugar (deoxyribose), ketohexose (psicose, fructose, sorbose, tagatose), aldohexose (allose, altrose, glucose, mannose, gulose, idose, galactose, talose), deoxy sugar (fucose, fuculose, rhamnose), sedoheptulose, sucrose, lactose, maltose, trehalose, turanose, cellobiose, raffinose, melezitose, maltotriose, acarbose, stachyose, glucose, starch (amylose, amylopectin), cellulose, dextrin, glucan, and fructose. These monosaccharides, disaccharides, polysaccharides or their derivatives may be used independently, or may be mixed. It is preferable that the nucleating agent be substantially soluble inside the oral cavity.

Examples of a binder include water-soluble polymers such as dextrin, gelatin, gum arabic, polyvinyl alcohol, and carboxymethyl cellulose. The addition amount of the binder is preferably not more than 10 wt % of the nucleating agent.

The flavor to be added to the nucleating agent is not particularly limited, and an existing flavor may be used. Flavor powder and flavor oil are particularly suitable. Principal flavor powders include powdered chamomile, fenugreek, menthol, mint, cinnamon, and herb. Principal flavor oils include oils of lavender, cinnamon, cardamom, celery, clove, cascarilla, nutmeg, sandalwood, bergamot, geranium, honey essence, rose oil, vanilla, lemon, orange, mint, cinnamon oil, caraway, cognac, jasmine, chamomile, menthol, cassia, ylang-ylang, serge, spearmint, fennel, pimento, ginger, anise, coriander, and coffee. These flavor powders and flavor oils may be used independently or may be mixed. When using a flavor powder, its particle size is preferably not larger than 500 μm. It is preferable that the flavor be substantially soluble in liquid or inside the oral cavity. The addition amount of the flavor component is preferably not more than 10 wt % of the nucleating agent.

Examples of a gustatory flavor include citric acid, tartaric acid, glutamic acid, Na, neotame, thaumatin, stevia, sorbitol, xylitol, erythritol, aspartame, rutin, hesperidin, oxalic acid, tannic acid, catechin, naringin, quinine, quinic acid, limonin, caffeine, capsaicin, vitamins, amino acids, polyphenols, alginic acid, flavonoid, and lecithin. It is preferable that the gustatory flavor be substantially soluble in liquid or inside the oral cavity. The addition amount of the gustatory flavor is preferably not more than 10 wt % of the nucleating agent. Note that the powder-containing substance 44 may be a plastic capsule including a powder, a tableted body, or granules.

<Effect>

According to the cigarette 1 of the embodiment, a smoker can inhale a powder by turning the powder-containing substance 44 into powder with application of external force. As a result, taste and/or aroma can be obtained. When the powder-containing substance 44 turns into powder, the powder can easily pass through the flow path 421. Hence, the smoker can easily inhale the powder at his/her own timing. The flow path 421 has a smaller inner diameter than the outer diameter of the powder-containing substance 44. Hence, the powder-containing substance 44 does not pass through the flow path 421. In other words, spilling of powder (powder spill) at timings other than smoking can be suppressed.

EXAMPLE

<<Measurement of Fracture Strength of Powder Compact>>

A compact was made by using lactose (Pharmatose 100M, DFE pharma) as a nucleating agent(crude powder) of the aforementioned powder-containing substance 44. A flavor powder compact as the powder-containing substance 44 was made by adding an adequate amount of flavor to the nucleating agent and mixing, adding an adequate amount of water and mixing, compacting the material into a spherical shape approximately 4.5 mm in diameter, and drying it for 24 hours at room temperature.

A creepmeter (RHEOMETER II, Yamaden co., Ltd) was used to measure fracture strength. To fix the powder-containing substance 44, a silicone film (rubber hardness 10°, thickness 1 mm) cut into 50 mm in diameter was placed on a stage of the creepmeter on which the powder compact is placed, and the same silicone film cut into 7.5 mm in diameter was placed on a pressing unit of the creepmeter. The traveling speed of the stage when pressing was 0.5 mm/sec, and the data detection speed was 0.2 sec. The fracture strength was set as the maximum load when pressing at a stage travel speed of 0.5 mm/sec.

<<Influence of Water Addition Amount>>

Figure 4:
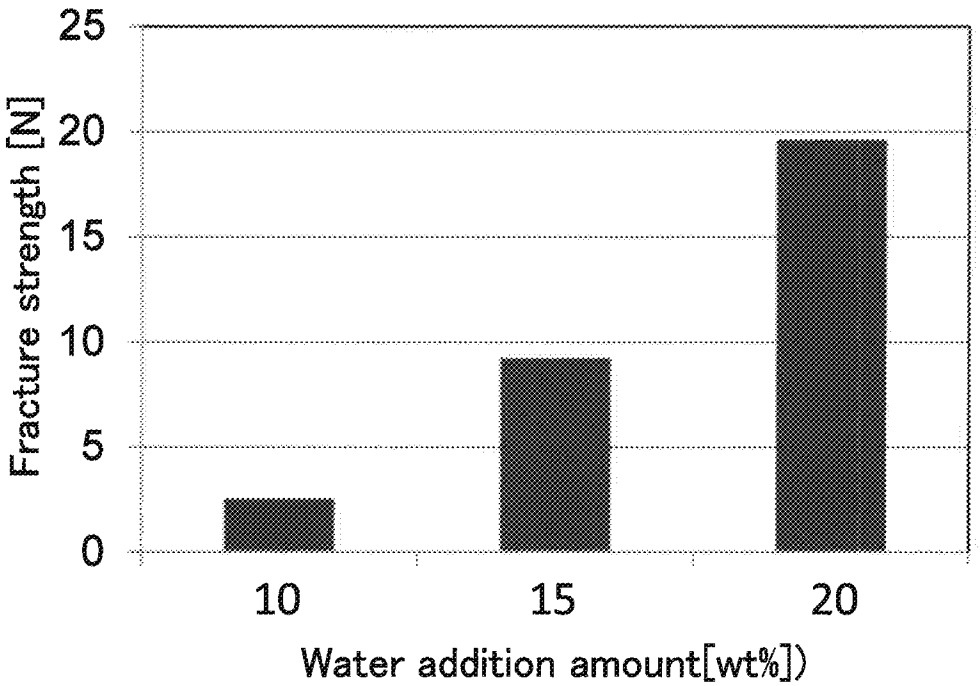
FIG. 4 illustrates a relationship between fracture strength and water addition amount.

FIG. 4 illustrates a relationship between fracture strength and water addition amount. It has been found from FIG. 4 that an increase in the water addition amount increases the fracture strength. This is thought to be because lactose wetted by the added water becomes viscous and serves as a binder. If the water addition amount is not more than 10 wt %, the amount of lactose acting as a binder reduces, whereby compaction becomes difficult with reduction in the addition amount. On the other hand, when the water addition amount exceeds 25 wt %, the slurry raw material obtained by adding water to lactose becomes less viscous, and compaction becomes difficult. It has been found that the strength of the compact increases in proportion to the water addition amount, that is, the amount of lactose acting as the binder, when between 10 wt % and 20 wt % water addition amount.

<<Influence of Flavor Addition>>

Figure 5:
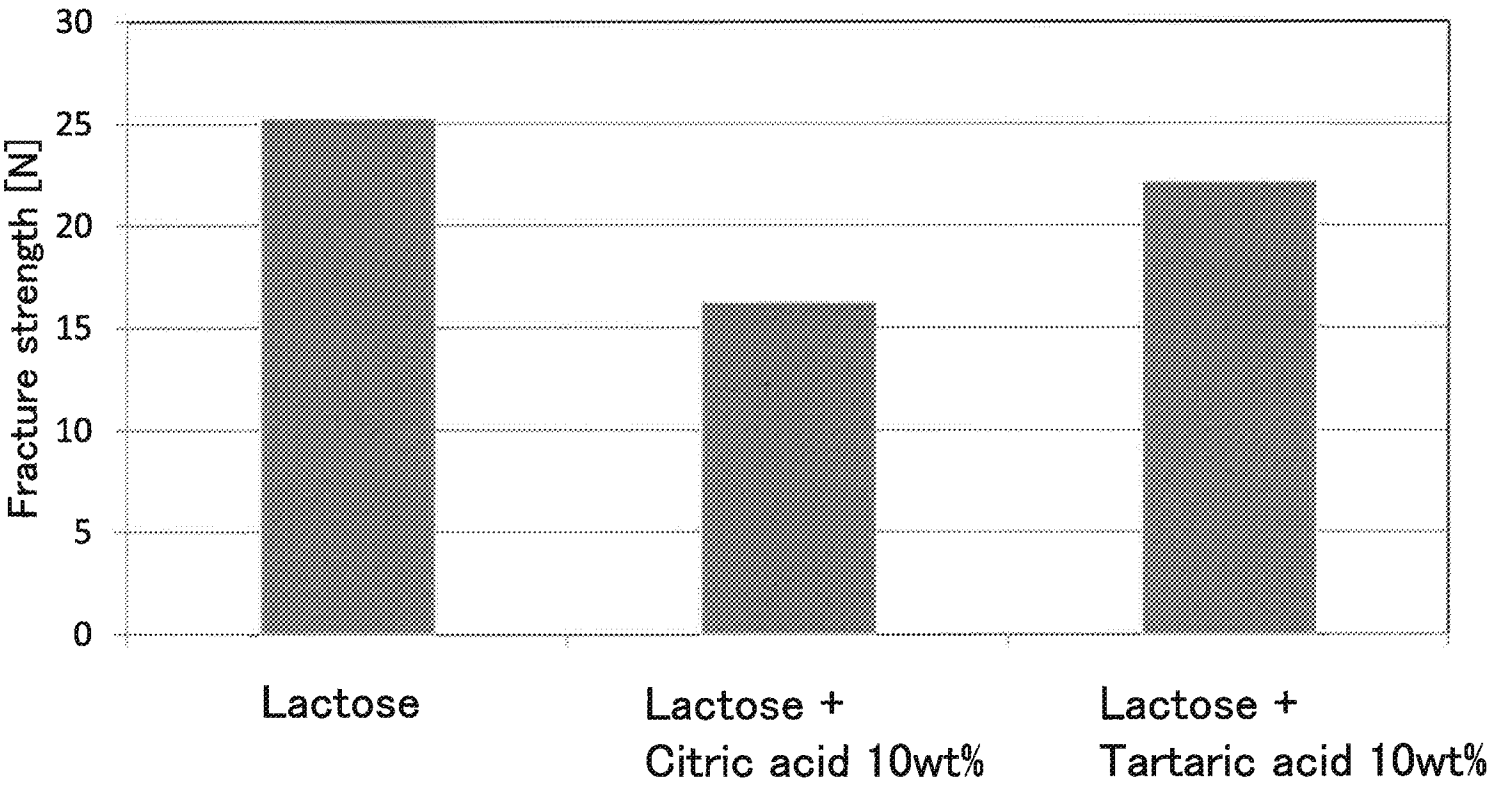
FIG. 5 illustrates measurement results of fracture strength when 10 wt % each of citric acid and tartaric acid were added, as a gustatory flavor, to lactose to which 20 wt % water has been added.

Fracture strength was measured after adding 10 wt % each of citric acid and tartaric acid, as a gustatory flavor, to lactose to which 20 wt % water has been added. FIG. 5 illustrates measurement results of fracture strength when 10 wt % each of citric acid and tartaric acid were added, as a gustatory flavor, to lactose to which 20 wt % water has been added. It can be seen from FIG. 5 that addition of the gustatory flavor caused a drastic drop in fracture strength in one comparative example, but did not cause a significant drop in the other comparative example. This is thought to be caused by the hygroscopicity of the added gustatory flavor. It is thought that addition of the highly hygroscopic, that is, highly water-soluble flavor causes the compact after compaction and drying to adsorb moisture in the atmosphere and melt, whereby strength of the compact drops.

<<Measurement of Particle Size Distribution after Fracture of Compact>>

The particle size distribution of a powder obtained by fracturing the powder-containing substance 44 was measured. Specifically, the powder obtained by fracturing the powder-containing substance 44 was poured into a stainless steel sieve of 600 μm aperture among stainless steel sieves (stainless steel sieve 75×20, apertures: 53 μm, 100 μm, 150 μm, 212 μm, 300 μm, and 600 μm, SANPO) whose weight were measured by an electronic balance (AB104-S, METTLER TOLEDO). The stainless steel sieves were stacked on top of one another in increasing order of the size of aperture of the stainless steel sieve, and were shook by a sieve shaker AS 200 control (Retsch) for 120 seconds at amplitude 1.50 mm/g. The powder obtained by fracturing the powder-containing substance 44 was measured by measuring the increase in weight of each stainless steel sieve by the electronic balance.

Figure 6:
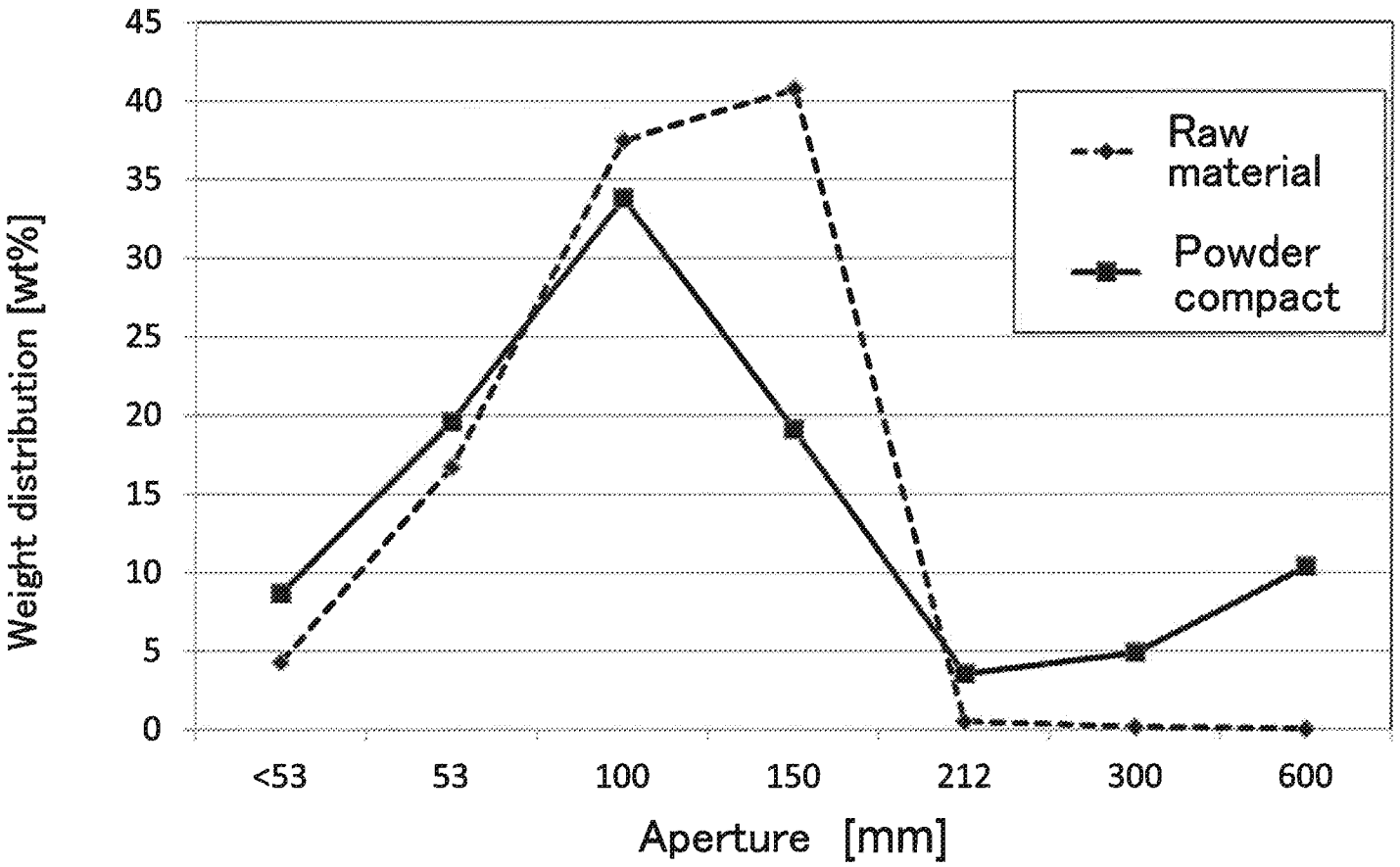
FIG. 6 illustrates a particle size distribution of powders obtained by fracturing, by the same method as in the above fracture strength measurement, crude lactose, and a powder-containing substance formed by adding 20 wt % water to lactose, compacting the material, and then drying.

FIG. 6 illustrates a particle size distribution of powders obtained by fracturing, by the same method as in the above fracture strength measurement, crude lactose, and a powder-containing substance formed by adding 20 wt % water to lactose, compacting the material, and then drying. In the crude lactose (referred to as "raw material" in FIG. 6), the powder weight of the particle size within the range of 100 to 212 μm is 75 wt % of the entire powder weight, and the powder weight of the particle size not smaller than 212 μm is less than 5 wt %. Meanwhile, in the powder-containing substance (referred to as "powder compact" in FIG. 6), the powder weight of the particle size within the range of 100 to 212 μm is not less than 50 wt % of the entire powder weight, and the powder weight of the particle size not smaller than 212 μm is less than 20 wt %. That is, it has been found that the powder weight in the crude powder is 75 wt % of the entire powder weight, and the powder weight in the compacted and fractured powder is 50 wt % of the entire powder weight. Accordingly, it has been found that an extremely high rate of the powder having the particle size within the range of 100 to 212 μm, which is adequate for inhaling, can be obtained after compaction and fracture.

<<Selection of Form of Powder-Containing Substance>>

(1) A plastic capsule, (2) a tableted body, (3) granules, and (4) a powder ball (equivalent to embodiment) were prepared as forms of the powder-containing substance 44, and checks concerning powder spill, delivery, and sense of crushing were performed. "Powder spill" checks loss of the powder due to an unintended powderization during production or shipment, delivery checks whether the powder moves easily from the cavity 43 to the mouthpiece end, and sense of crushing checks the change in the feel when turning the powder-containing substance 44 into powder. Delivery and sense of crushing are, in other words, items checked for determining whether the cigarette 1 can be used easily. (1) The plastic capsule was made by including the powder inside a plastic capsule. (2) A hollow cylinder-shaped tableted body and a disk-shaped tableted body were made. (3) The granules were made by extruding a slurry obtained by adding water to a crude powder, and drying the material. The drying conditions were an hour at 50° C. (4) The powder ball (equivalent to embodiment) was made by adding water to a crude powder to obtain a slurry, compacting the slurry into a sphere shape, and drying the material. The drying conditions were an hour at 50° C.

As a result, (4) the powder ball (equivalent to embodiment) obtained excellent results for each of powder spill, delivery, and sense of crushing.

Embodiment 2

Figure 7:
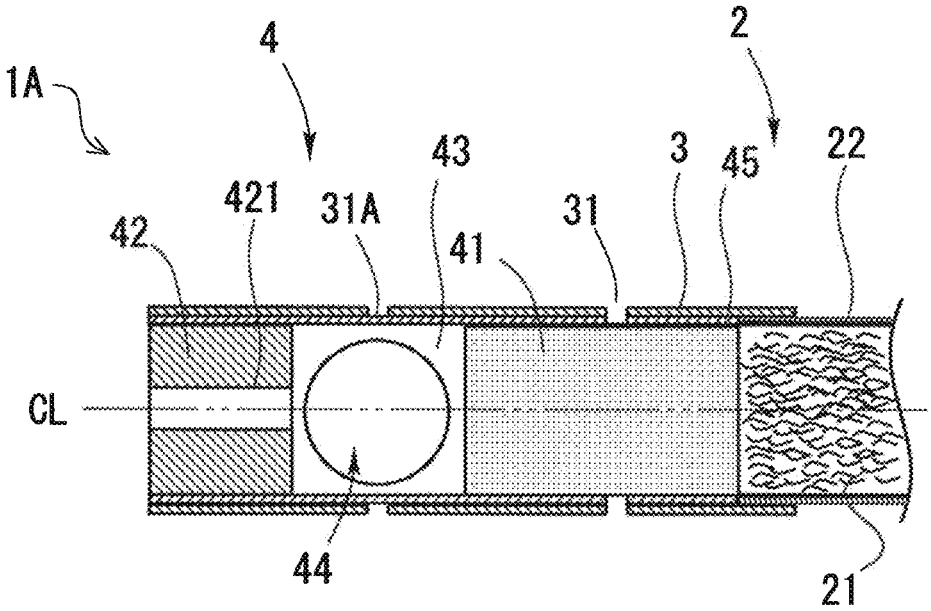
FIG. 7 illustrates a longitudinal section of a cigarette of Embodiment 2.

Next, a cigarette 1A of Embodiment 2 will be described. Here, points different from the cigarette 1 of Embodiment 1 illustrated in FIGS. 1 to 3 will mainly be described. FIG. 7 is a schematic configuration diagram of the cigarette 1A of Embodiment 2. In a filter 4 of the cigarette 1A, an additional air hole (hereinafter referred to as "cavity area-air hole") 31A is formed in a position of a tipping paper 3 corresponding to a cavity 43. In other words, the filter 4 of the cigarette 1A has an air hole (hereinafter referred to as "upstream filter area-air hole") 31 provided in a position corresponding to an upstream filter 41, and the cavity area-air hole 31A, which are formed as through holes penetrating the tipping paper 3. These holes allow intake of dilution air for diluting mainstream smoke into the filter 4. Note that in the embodiment, it is preferable that a pre-perforated tipping paper in which Vf apertures are previously famed in the tipping paper 3 be used. This eliminates the risk of damaging a powder-containing substance 44 placed in the cavity 43, as compared to a case of using Vf apertures formed by an on-machine laser, for example. Note that as for a wrapping paper 45, use of an appropriate highly air-permeable wrapping paper enables transmission of the air taken in from the outside through the cavity area-air hole 31A in the tipping paper 3, to the inside of the cavity 43. This has an advantage that the wrapping paper 45 becomes stronger and is less likely to break.

The filter 4 of the cigarette 1A of the embodiment is provided with air holes for taking in dilution air, on both of the cavity 43 and the upstream filter 41. Hence, by adjusting the balance of amount of air flowing in from these air holes, it is possible to vary the delivery amount of powder (e.g., flavor powder) formed by crushing the powder-containing substance 44, without varying the overall Vf value (rate of amount of intake air from a filter to an overall ventilation amount) of the filter 4. Accordingly, it is possible to design an optimal taste (gustatory) intensity by the flavor powder, while maintaining a constant tar value of the cigarette 1A, for example.

Example

Figure 8:
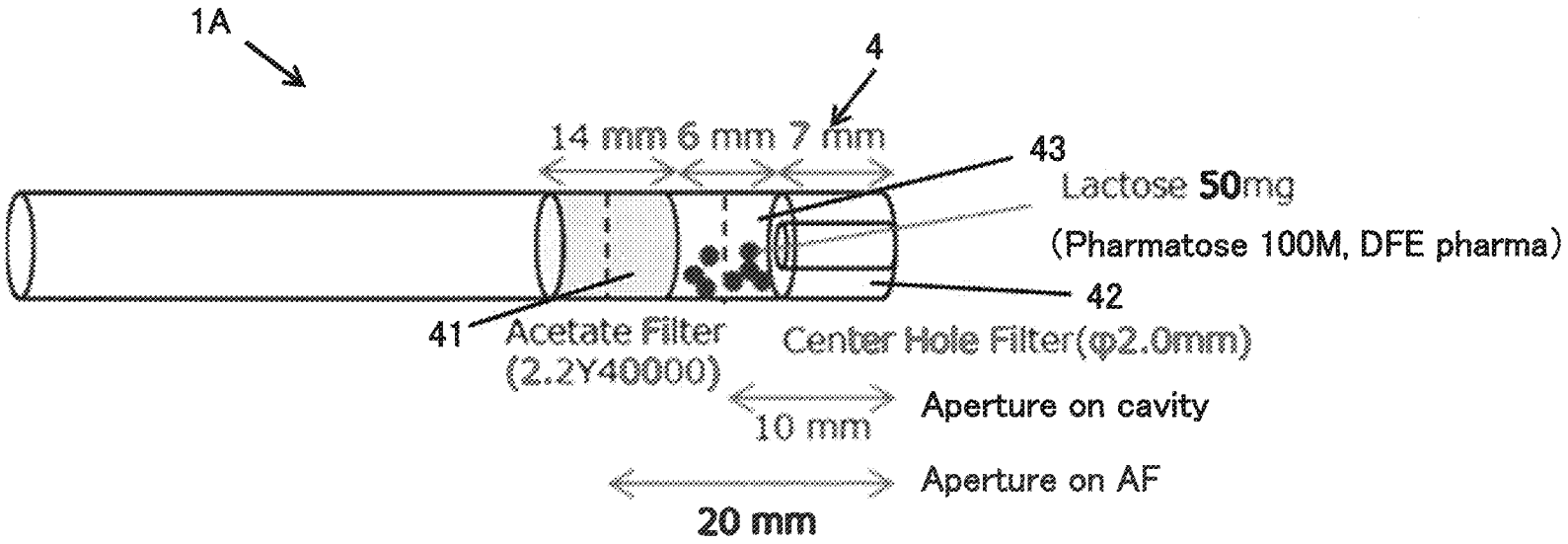
FIG. 8 illustrates details of the cigarette of Embodiment 2.

The above cigarette 1A was made, and its powder delivery amount during inhalation was measured. FIG. 8 illustrates details of the cigarette 1A of an example of Embodiment 2. In the filter 4 of the cigarette 1A, the upstream filter 41, the cavity 43, and a downstream filter 42 were arranged in this order from a tobacco rod 2 side. The length of the upstream filter 41 was set to 14 mm, the length of the cavity 43 was set to 7 mm, and the length of the downstream filter 42 was set to 7 mm. The upstream filter 41 was an acetate filter, and the downstream filter 42 was a center hole filter having a center hole with a 2 mm diameter in its center. Assuming a state after fracture of the powder compact, a nucleating agent (crude powder) of the powder-containing substance 44 was accommodated in the cavity 43. Lactose 50 mg (Pharmatose 100M, DFE pharma) was used as the crude powder of the powder-containing substance 44.

The cavity air hole 31A was formed in a position 10 mm away from the mouthpiece end. The cavity upstream air hole 31 was formed in a position 20 mm away from the mouthpiece end. The cavity air hole 31A and the cavity upstream air hole 31 were formed in the tipping paper by using a commercial Vf marker (KEYENCE 3-Axis CO2 LASER MARKER). At this time, the marked character was "X," the width was set to 0.1 mm, the height was set to 0.4 mm, and the spacing of the character (aperture) was set to 0.508 mm, and the intensity of laser of the Vf marker was adjusted to obtain a predetermined Vf value.

In the cigarette 1A produced in the above manner and including the powder-containing substance 44 famed of the lactose powder in the cavity 43, the rate of intake air (Vf value) from the filter 4 was varied by adjusting the laser marking condition, and the delivery amount of powder (lactose) during inhalation was measured.

The Vf values were measured by use of SODIMAX D74/SODIM of S.A.S. FIG. 9 illustrates a table of Vf value measurement results. Note that in FIG. 9, "aperture on AF" corresponds to the upstream filter area-air hole 31, and "aperture on Cavity" corresponds to the cavity area-air hole 3.

Figure 10:
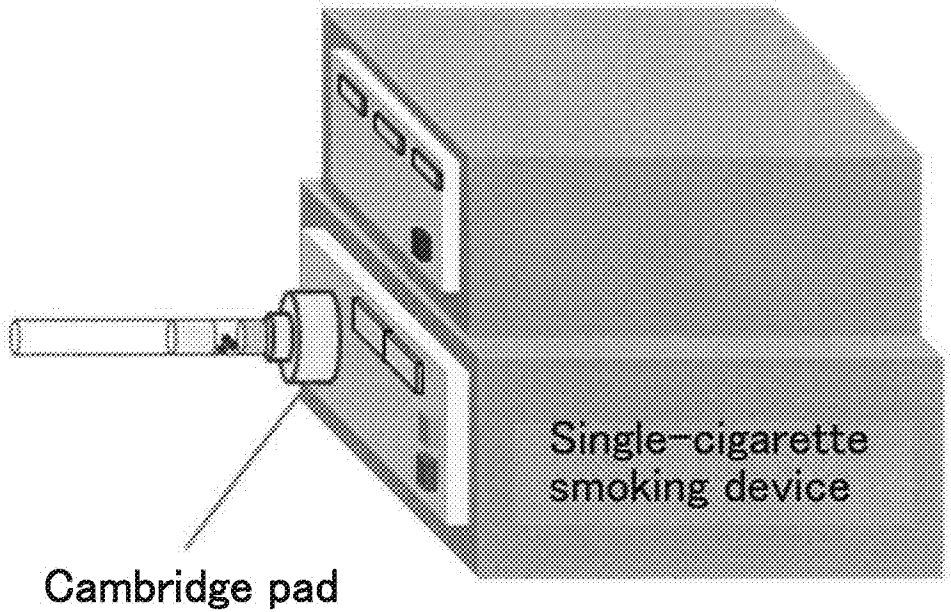
FIG. 10 illustrates a smoking device used for measuring a powder delivery amount in the example of Embodiment 2.

A smoking device illustrated in FIG. 10 was used to measure the powder delivery amount. In the example, a single-cigarette smoking device of Borgwaldt was used, and an inhalation experiment was performed without lighting the cigarette to measure the powder delivery amount. The inhalation experiment was performed by setting the inhalation flow rate to 35 mL/2 sec, the number of inhalations to five times, and the number of measured cigarettes to five. The powder delivery amount was obtained by removing a powder collection pad (Cambridge pad) at every inhalation, measuring its weight by the electronic balance, and calculating by use of the difference in weight before and after the inhalation.

Figure 11:
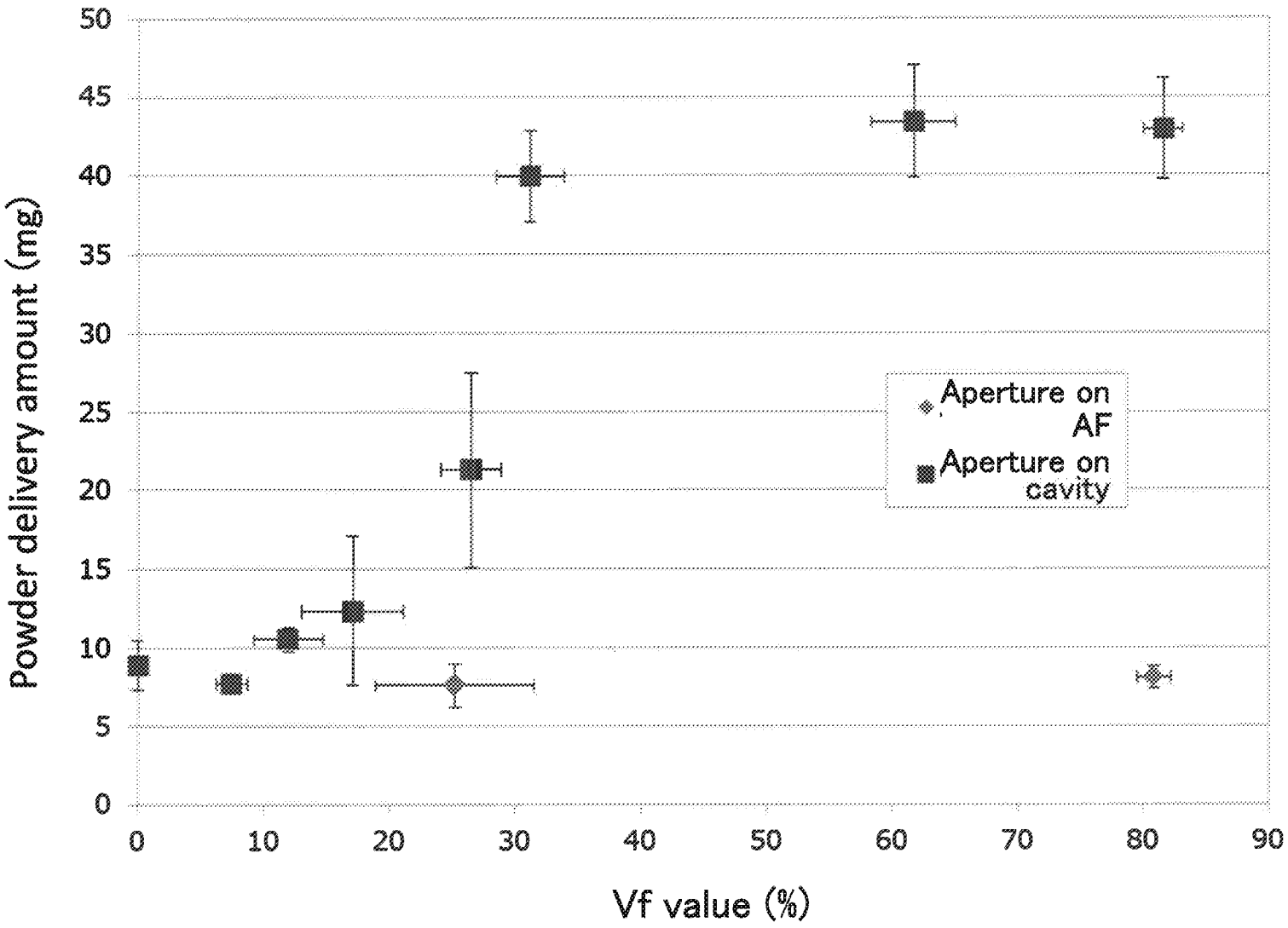
FIG. 11 illustrates measurement results of the powder delivery amount of the example of Embodiment 2.

FIG. 11 illustrates measurement results of the powder delivery amount of the example. In the case of the upstream filter area-air hole 31 ("aperture on AF" in FIG. 11), the powder delivery amount did not change significantly with variation in the Vf value. However, in the case of the cavity area-air hole 31A ("aperture on Cavity" in FIG. 11), the powder delivery amount increased significantly when the Vf value was in the range of 12% to 31%. Hence, it has been found that even with the same Vf value, the powder delivery amount can be controlled by adjusting the balance of air taken into the filter 4, through the upstream filter area-air hole 31 and the cavity area-air hole 31A. For example, to adjust a cigarette to have about 20 mg powder delivery amount when the Vf value is 80%, a desired cigarette can be obtained by adjusting the aperture conditions such that the rate of air intake is 25% through the cavity area-air hole 31A, and 55% through the upstream filter area-air hole 31. In the case of the example, it was able to vary the powder delivery amount within the range of 7.7 to 43.4 mg, by varying the balance between the Vf value of the cavity area-air hole 31A and the Vf value of the upstream filter area-air hole 31. It is thus possible to vary the amount of flavor powder within about five-fold range with the same Vf value. Accordingly, it is possible to design an optimal taste intensity by the flavor powder, while maintaining a constant tar value of the cigarette.

<Modification>

Note that although the cigarette 1A of Embodiment 2 has the upstream filter area-air hole 31 and the cavity area-air hole 31A, respectively, in positions corresponding to the upstream filter 41 and the cavity 43 of the filter 4, the upstream filter area-air hole 31 may be omitted, and just the cavity area-air hole 31A may be provided instead. The cavity area-air hole 31A penetrating the tipping paper 3 may be provided in the filter 4, in a position corresponding to the cavity 43. The Vf value may be adjusted by adjusting the opening area (total opening area in a case of arranging multiple cavity area-air holes 31A) of the cavity area-air hole 31A. It is possible to design the tar value of the cigarette according to the Vf value, and deliver the maximum amount of the flavor powder.

Embodiment 3

Figure 12:
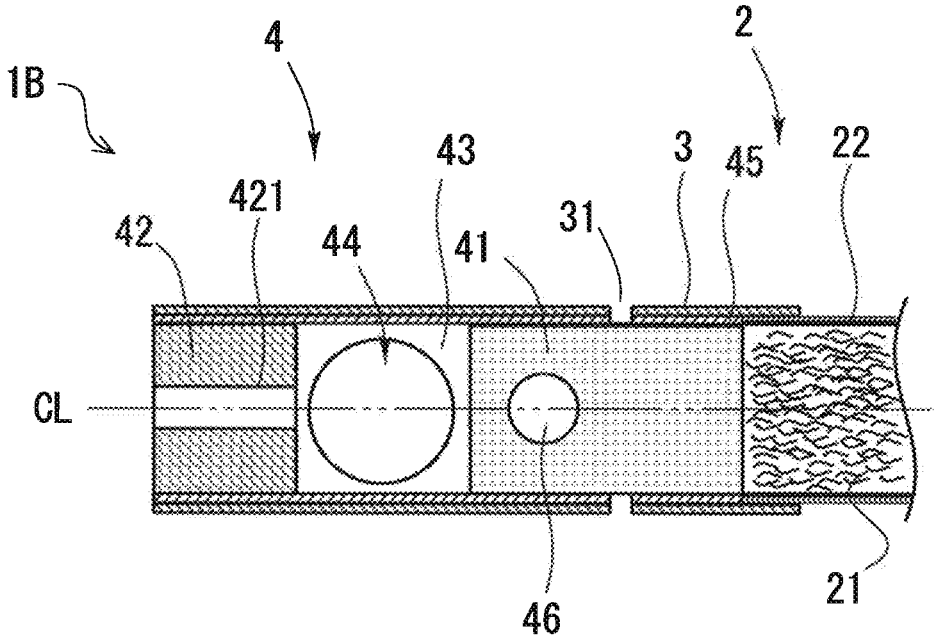
FIG. 12 illustrates a longitudinal section of a cigarette of Embodiment 3.

Next, a cigarette 1B of Embodiment 3 will be described. Here, points different from Embodiments 1 and 2 will mainly be described. FIG. 12 is a diagram illustrating a longitudinal section of the cigarette 1B of Embodiment 3. In a filter 4 of the cigarette 1B, a flavor capsule 46 including a flavor is provided, in addition to a powder-containing substance 44, which is a powder ball as a lump of a crude powder containing a gustatory component or a flavor component. In the example illustrated in FIG. 12, the flavor capsule 46 is buried in filter fiber (e.g., acetate fiber) of an upstream filter 41, which is positioned on the upstream side of a cavity 43 in the filter 4. The flavor capsule 46 may be a seamless capsule used in a commercial capsule cigarette.

According to the cigarette 1B of the embodiment, by containing a taste component in the powder-containing substance 44, such as a powder ball, and containing an aroma component in the flavor capsule 46, the user can selectively crush one of them to selectively customize the intensity of the taste component and the aroma component. Instead, the user may crush both of the powder-containing substance 44 and the flavor capsule 46, to customize the intensity of both of the taste component and the aroma component.

The cigarette 1B may include an aroma component in both of the powder-containing substance 44 and the flavor capsule 46. This allows use of an individual aroma component or a mixture of multiple aroma components, so that the user may enjoy variation in taste. Since aroma components are relatively volatile, an aroma maintaining function is preferably added to ensure storability. Although the aroma maintaining function may be added to the powder-containing substance during production, storability can be easily ensured by configuring the powder-containing substance 44 only of nonvolatile taste components. It is also possible to interpolate the aroma component, by configuring the flavor capsule 46 of a seamless capsule or the like that have high storability. Thus, it is possible to provide a cigarette that enables the user to customize intensity of aroma components according to his/her preference, while ensuring excellent storability.

Note that although the flavor capsule 46 is placed in the upstream filter 41 in the example illustrated in FIG. 12, it may be placed in the cavity 43 or the downstream filter 42 instead. Note, however, that it is preferable in the following points that the flavor capsule 46 be placed in the upstream filter 41 as in FIG. 12. As compared to placing the flavor capsule 46 in the downstream filter 42 where the flow path 421 as a center hole is formed, it is preferable to place the flavor capsule 46 in the upstream filter 41, from the viewpoint of ease in production (mountability) when producing the filter 4. If the flavor capsule 46 is placed in the downstream filter 42, mainstream smoke flowing through the hollow flow path 421 in the downstream filter 42 is less likely to receive the aroma component when the flavor capsule 46 is crushed. Hence, instead of placing the flavor capsule 46 in the downstream filter 42, it is more preferable from the viewpoint of increasing flavor release, to place the flavor capsule 46 in the upstream filter 41.

Since the powder-containing substance 44 such as a powder ball is placed in the cavity 43, in tams of usefulness for the user to selectively crush the flavor capsule 46 and the powder-containing substance 44, it is preferable that the flavor capsule 46 be placed in the upstream filter 41, instead of placing both of them in the cavity 43. By placing the flavor capsule 46 in a part separate from the powder-containing substance 44, the user is allowed to easily select and crush the desired one of the flavor capsule 46 and the powder-containing substance 44.

Moreover, although the flavor capsule 46 is placed on the downstream side (mouthpiece side) of the upstream filter area-air hole 31 of the upstream filter 41, the positional relationship between the upstream filter area-air hole 31 and the flavor capsule 46 is not particularly limited. For example, the installation position of the flavor capsule 46 in the upstream filter 41 may be immediately below the upstream filter area-air hole 31, or may be on the upstream side (tobacco rod 2 side) of the upstream filter area-air hole 31. Note, however, that the flow rate is higher on the downstream side (mouthpiece side) of the upstream filter area-air hole 31 than on the upstream side (tobacco rod 2 side) in the upstream filter 41, as illustrated in FIG. 12. Hence, placing the flavor capsule 46 in such a position is advantageous in that a larger amount of aroma components can be released.

On the other hand, the flow rate is lower on the upstream side (tobacco rod 2 side) of the upstream filter area-air hole 31 than on the downstream side (mouthpiece side) in the upstream filter 41. However, there is an advantage that when the aroma component is released from the flavor capsule 46, the aroma component is more likely to contact mainstream smoke than dilution air, and therefore is easily mixed with mainstream smoke. Also, as described in the modification of Embodiment 2, the cavity area-air hole 31A may be provided in the filter 4 in a position corresponding to the cavity 43. This configuration also has the advantage that the aroma component easily mixes with mainstream smoke. When installing the flavor capsule 46 immediately below the upstream filter area-air hole 31 in the upstream filter 41, it is advantageous to use a pre-perforated tipping paper in which air holes are formed in advance, instead of opening the air holes with on-machine laser (air holes with laser marking with Vf marker). This eliminates the risk of breaking the flavor capsule 46 even when there is a shift (error) in the installation position of the flavor capsule 46 or the forming position of the upstream filter area-air hole 31.

Figure 13:
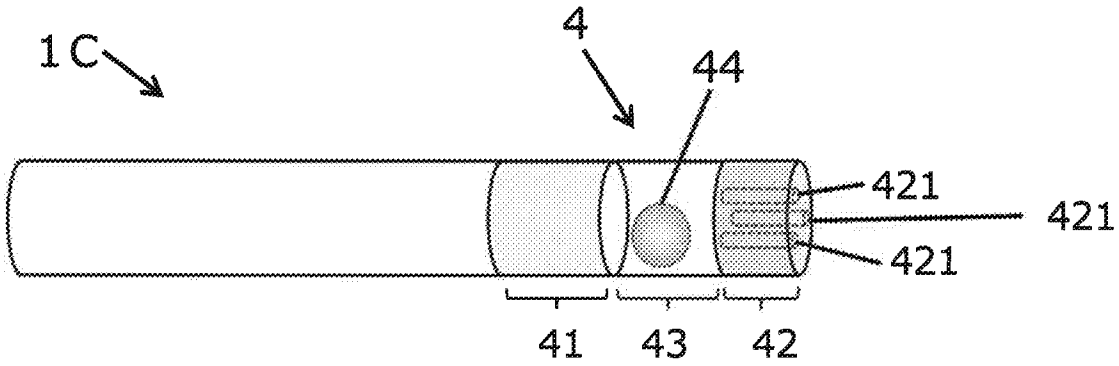
FIG. 13 illustrates another configuration example of a flow path provided in a downstream filter of a filter.

Note that although the above embodiments describe a case where the downstream filter 42 of the filter 4 is a center hole filter having a single flow path 421, multiple flow paths 421 may be provided in the downstream filter 42, as in the case of a filter 4 of a cigarette 1C illustrated in FIG. 13. For example, in the example illustrated in FIG. 13, three flow paths 421 penetrating the downstream filter 42 in the axial direction are provided. When providing multiple flow paths 421 in the downstream filter 42, it is preferable that the inner diameter of all of the flow paths 421 be smaller than the diameter of the powder-containing substance 44. With this configuration, all of the flow paths 421 can block passage of the powder-containing substance 44. Note that the inner diameter of the flow path 421 does not necessarily have to be constant, and may vary. In this case, the inner diameter may be set in any way, as long as the inner diameter is set smaller than the outer diameter of the powder-containing substance 44, in a part where the inner diameter becomes the smallest in the longitudinal direction of the flow path 421.

Although preferred embodiments of the present invention have been described, the cigarette 1 of the present invention may be implemented by any possible combination of the embodiments.

REFERENCE SIGNS LIST

1 . . . cigarette
2 . . . tobacco rod
21 . . . tobacco
3 . . . tipping paper
31 . . . air hole
4 . . . filter
41 . . . upstream filter
42 . . . downstream filter
43 . . . cavity
44 . . . powder-containing substance
45 . . . wrapping paper
421 . . . flow path

The invention claimed is:

1. A smoking article comprising:
a tobacco rod containing tobacco; and
a filter connected to an end part of the tobacco rod through a tipping paper,
wherein the filter includes:
a powder-containing substance that is a compacted powder containing a flavor component, and turns into loose powder when external force is applied thereon;
a cavity in which the powder-containing substance is placed;
a downstream filter positioned on a downstream side of the cavity that connects the cavity and a mouthpiece end;
a flow path which is a through hole in the downstream filter that allows passage of the loose powder, and has an inner diameter that is smaller than an outer diameter of the powder-containing substance and larger than a maximum particle size of the loose powder.

2. The smoking article according to claim 1, wherein an outer diameter of the powder-containing substance is not smaller than 1 mm and not larger than 8 mm.

3. The smoking article according to claim 1, wherein a fracture strength that turns the compacted powder into loose powder is not lower than 5 N and not higher than 60 N.

4. The smoking article according to claim 1, wherein the loose powder has a particle size not smaller than 10 μm and not larger than 600 μm is not less than 50 wt % of the entire weight of the powder-containing substance.

5. The smoking article according to claim 1, wherein an air hole that takes dilution air into the filter is provided in the tipping paper, in a position corresponding to the cavity.

6. The smoking article according to claim 5, wherein the filter has an upstream filter positioned on an upstream side of the cavity, and
wherein the air hole in the tipping paper is provided not only in the position corresponding to the cavity, but also in a position corresponding to the upstream filter.

7. The smoking article according to claim 1, wherein a flavor capsule including a flavor is also provided in the filter.

8. The smoking article according to claim 7, wherein:
the filter also has an upstream filter positioned on the upstream side of the cavity; and
the flavor capsule is placed in the upstream filter.

9. A filter of a smoking article comprising:
a powder-containing substance that is a compacted powder having a flavor component, and turns into a loose powder when external force is applied thereon;
a cavity in which the powder-containing substance is placed;
a downstream filter positioned on a downstream side of the cavity that connects the cavity and a mouthpiece end; and
a flow path which is a through hole in the downstream filter that allows passage of the loose powder, and has an inner diameter that is smaller than an outer diameter of the powder-containing substance and larger than a maximum particle size of the loose powder.

* * * * *